United States Patent [19]

Bridges

[11] 4,127,753

[45] Nov. 28, 1978

[54] HINGE TERMINAL MOUNTING FOR ELECTRIC CIRCUIT DISCONNECT SWITCH

[76] Inventor: Ronald P. Bridges, 9 S. 681 Brookeridge Rd., Downers Grove, Ill. 60515

[21] Appl. No.: 845,879

[22] Filed: Oct. 27, 1977

[51] Int. Cl.[2] ..... H01H 31/00; H01H 1/42

[52] U.S. Cl. ..... 200/48 KB; 200/162; 200/272

[58] Field of Search ..... 200/48 R, 48 KB, 48 SB, 200/162, 254, 271, 272

[56] References Cited

U.S. PATENT DOCUMENTS

| | | | |
|---|---|---|---|
| 1,962,293 | 6/1934 | Bowie | 200/48 R |
| 2,347,030 | 4/1944 | Crabbs | 200/162 |
| 2,849,554 | 8/1958 | Curtis et al. | 200/48 R |

*Primary Examiner*—William Price

*Assistant Examiner*—Steven M. Pollard

*Attorney, Agent, or Firm*—Wegner, Stellman, McCord, Wiles & Wood

[57] ABSTRACT

An electric circuit disconnect switch has an improved hinge terminal mounting in which a rotatable blade has a hinge terminal end portion in which opposite faces are provided with sockets which are essentially hemispherical about a common axis, and a terminal connector has a bifurcated end portion defining a bight and effectively parallel arms which flank said faces of the blade and have threaded holes on said common axis near their free ends. Pivot studs which screw into the holes have hemispherical extremities seated in the sockets so that seating force applied by turning the studs spreads the arms and thus thrusts the pivot studs firmly into the sockets. A compression spring and an adjusting bolt and nut between the bight and the studs biases the arms toward one another with adjustable force.

12 Claims, 2 Drawing Figures

HINGE TERMINAL MOUNTING FOR ELECTRIC CIRCUIT DISCONNECT SWITCH

CROSS-REFERENCE TO RELATED APPLICATION

The group circuit disconnect mechanism which is shown and described generally in this application is shown and described in detail and claimed in my copending application for U.S. Letters Pat., Ser. No. 783,940, filed Apr. 1, 1977 issued June 13, 1978 as U.S. Pat. No. 4,095,061.

BACKGROUND OF THE INVENTION

The design of circuit disconnect switches for electrical power transmission lines presents a variety of problems, one of which is the need to connect the hinge terminal end of the switch blade to the electric power line in such a way that the blade may be pivoted relatively easily while still maintaining a substantially resistance-free electrical connection to the power line.

A typical prior art hinge terminal mounting has a portion of the blade aligned with the axis of rotation of a rotatable support upon which the blade is fixedly mounted; and a terminal connector which is adapted to be connected to a power transmission line has spaced sets of multiple leaf spring arms bearing against opposite sides of the hinge terminal end portion of the blade so that that portion of the blade rotates between the multiple leaf spring arms as the blade is opened and closed. In such a construction, the leaf spring arms are rather heavily stressed and have substantial surface areas in contact with the blade surfaces, tending to make the blade difficult to turn.

The leaf spring arms are subject to fatigue failure, particularly because of the fact that such switches are nearly always mounted in outdoor locations where they are exposed to the weather, and there is no satisfactory way to protect the leaf spring arms from the weather or to seal the contact areas between the spring arms and the blade surfaces.

Curtis et al U.S. Pat. No. 2,849,554 discloses another type of hinge terminal connection for an electric circuit disconnect switch.

SUMMARY OF THE INVENTION

In accordance with the present invention, the hinge terminal end portion of the blade has opposite faces provided with sockets which are essentially hemispherical about a common axis which is on a projection of the axis of rotation of the support upon which the blade is mounted. A terminal connector has a bifurcated end portion which defines a bight and effectively parallel arms which flank the faces of the blade in parallel planes which are normal to the axis of rotation of the rotatable support. Axially aligned threaded holes in the outer end portions of the arms receive threaded studs which have hemispherical end portions seated in the sockets in the blade. As the studs are screwed into the sockets so that their hemispherical end portions are thrust more and more strongly into the blade sockets, the arms are sprung slightly outwardly by the reaction between the interengaging screw threads, so that the resiliency of the arms serves to thrust the pivot studs firmly into the socket. After the studs are adjusted to a desired pressure, lock nuts are screwed onto the studs to secure them firmly in place.

Between the threaded holes and the bight, the arms are loosely impaled by an adjusting bolt which has a compression spring between the bolt head and one of the arms, while an adjusting nut screws onto the opposite end of the bolt and bears upon the other arm. Thus, the adjustable spring arrangement biases the arms toward one another and reduces or eliminates any tendency of the thrust from the studs to overstress or break the bifurcated terminal connector at the bight.

The effectively hemispherical complementary sockets and stud end portions eliminate the need for perfect parallelism between the terminal connector arms and the blade, and permit the terminal connector to be mounted directly upon the power transmission line, instead of requiring that the terminal connector be mounted upon the support to maintain a fixed relationship between the support and the blade.

The present structure also permits O-rings to be positioned surounding the studs and sealing the space between the blade faces and the arms, so that the contact surfaces between the studs and the blade are sealed from the weather.

THE DRAWINGS

FIG. 1 is a side elevational view of a group operated circuit disconnect apparatus, adapted for pole top mounting, in which the hinge terminal mountings of the circuit disconnect switches embody the present invention; and FIG. 2 is a fragmentary sectional view on an enlarged scale taken substantially as indicated along the line 2—2 of FIG. 1.

DETAILED DESCRIPTION OF THE INVENTION

Figure 1:
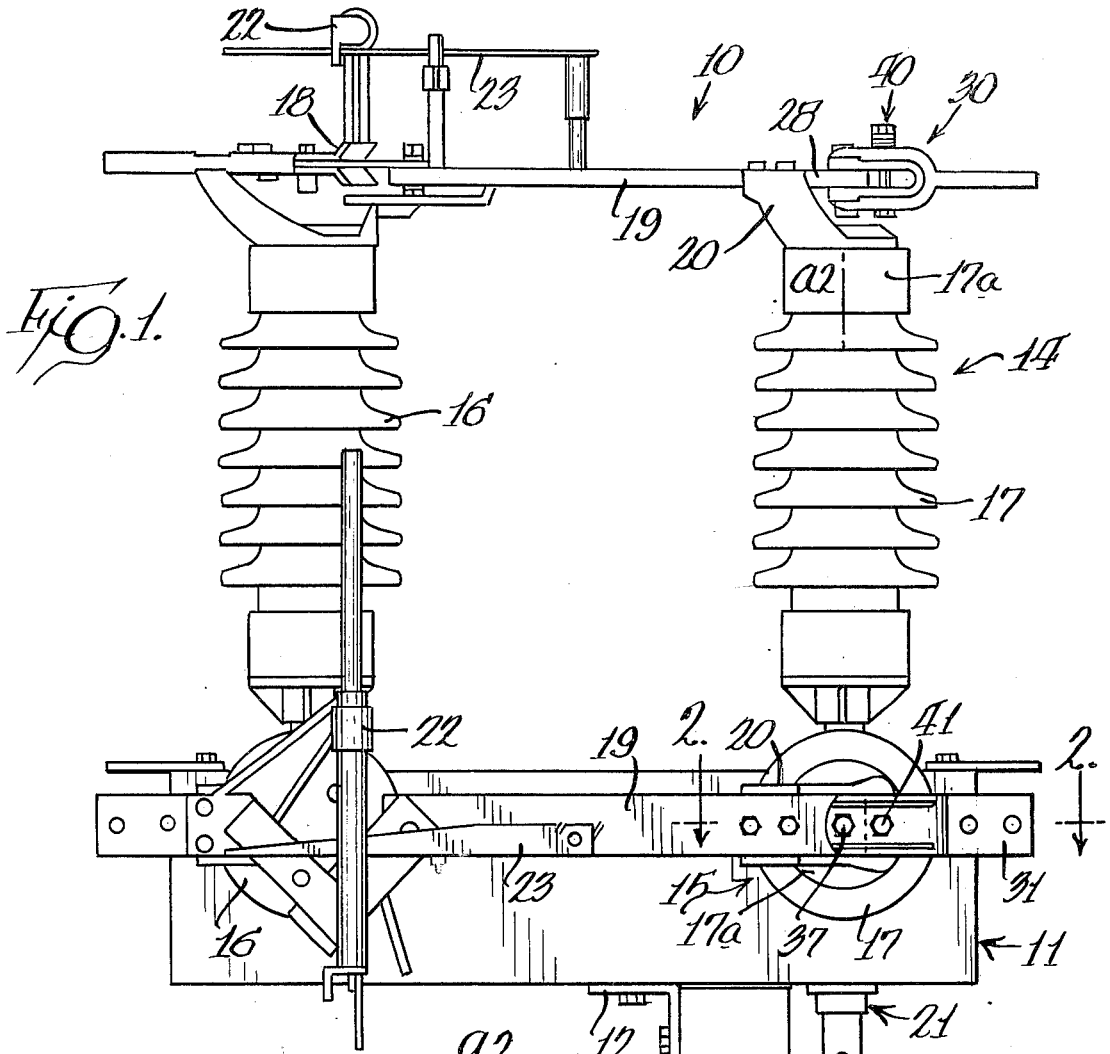

As seen in FIG. 1, a group operated circuit disconnect apparatus, indicated generally at 10, includes a base, indicated generally at 11, which consists of a box-like housing on the bottom of which are an angle bracket 12 and a channel bracket 13 by means of which the apparatus may be mounted on top of a pole.

A first disconnect switch, indicated generally at 14, surmounts the base 11; while a second disconnect switch, indicated generally at 15 is supported in a horizontal position on one side of the base 11. A third disconnect switch (not shown) is aligned with the switch 15 on the opposite side of the base 11.

The three disconnect switches are identical, and are seen to consist of a fixed insulator 16, a rotatable insulator 17, a fixed jaw 18 mounted upon the fixed insulator 16, and a blade 19 which is mounted upon the rotatable insulator 17 by means of a bracket 20 for movement between a normal position in which it is held in the jaw 18 and an open position rotated about 90° from the fixed position.

The insulator 17 is mounted upon an upright shaft means, indicated generally at 21, which extends entirely through the box-like base 11 and is journalled in the top and bottom wall thereof. Thus, rotation of the upright shaft means 21 rotates the insulator 17 to open or close the disconnect switch 14. A transverse shaft means (not shown) extends through the housing sidewalls and is journalled therein so that rotation of that shaft means rotates the insulator 17 of the switch 15 and a corresponding insulator of the switch which is not shown in FIG. 1. Inside the box-like housing 11 is a mechanism by which rotation of the upright shaft means 21 is transmitted to the transverse shaft means (not shown). For a detailed description of such operating mechanism, reference is made to applicant's copending application heretofore referred to in the Cross-Reference To Related Application.

If necessary for the particular operating conditions, each of the disconnect switches may be provided with an interrupter member 22 which is operated by an arm 23 on the blade 19. The particular interrupter member and actuating arm illustrated in the drawings are those of applicant's U.S. Pat. No. 4,031,346, issued June 21, 1977.

Figure 2:
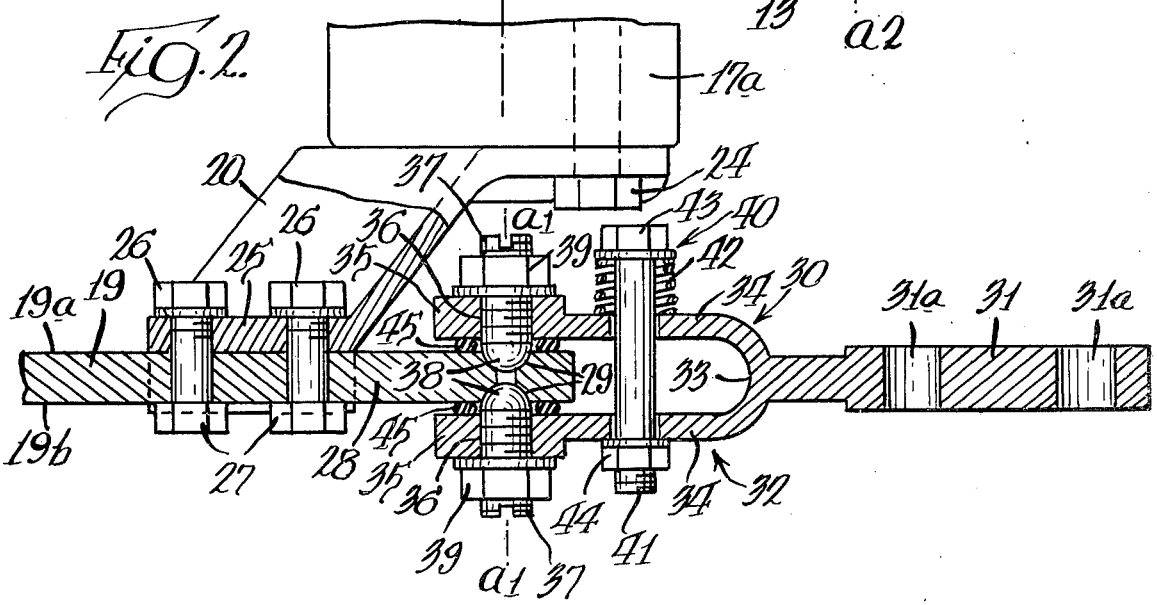

Referring now particularly to FIG. 2, the rotatable insulator 17 is seen to have a cap member 17*a* to which the mounting bracket 20 for the blade 19 is secured by bolts 24; and a flange 25 on the bracket 20 abuts a face 19*a* of the blade 19 so that the blade may be secured to the bracket 20 by bolts 26 which impale the flange and the blade and are secured by nuts 27. A hinge terminal end portion 28 of the blade 19 has the face 19*a* and an opposite face 19*b* of the blade provided with generally hemispherical sockets 29 which are formed about a common axis *a*1–*a*1 which is substantially on a projection of the axis *a*2–*a*2 of the shaft means and insulator 17 which serve as a rotatable support for the blade 19.

A terminal connector, indicated generally at 30, includes a mounting plate 31 and a bifurcated end portion, indicated generally at 32, which defines a bight 33 and substantially parallel arms 34 which are in spaced, flanking relationship to the opposite faces 19*a* and 19*b* of the hinge terminal end portion 28 of the blade 19. The arms 34 have enlarged outer end portions 35 in which there are threaded holes 36; and pivot studs 37 have threads which engage the threads of the holes 36 so that the pivot studs 37 may be screwed through the extremities 35 of the arms 34 until hemispherical end portions 38 of said studs 37 are seated in the hemispherical sockets 29. The thrust of the pivot studs 37 in the sockets 29 is carried through the stud threads and the threads of the holes 36 to flex the arms 34 outwardly with respect to the opposite blade faces 19*a* and 19*b*, so that the flexing of the arms assures that the thrust of the pivot studs 37 into the sockets 29 is very firm. Once a desired pressure is reached between the hemispherical stud end portions 38 and the hemispherical sockets 29, lock nuts 39 are screwed onto the studs to assure that the thrust of the studs into the sockets is maintained.

Between the bight 33 and the pivot studs 37 is resilient means, indicated generally at 40, which biases the arms 34 toward one another. The resilient means 40 includes a bolt 41 which loosely impales holes in the arms 34, a compression spring 42 which encircles the bolt 41 between a bolt head 43 and the adjacent arm 34, and a nut 44 which is screwed onto the bolt 41 and bears against the opposite arm 34. Thus, adjustment of the nut 44 on the bolt 41 varies the force with which the spring 42 biases the arms 34 toward one another.

The mounting plate 31 of the terminal connector 30 is provided with holes 31*a* the axes of which are parallel to the common axis *a*1; and the mounting plate 31 and holes 31*a* provide means which adapts the terminal connectors 30 to be connected to a power transmission line in the conventional way. The orientation of the holes 31*a* with respect to the pivot studs 37 assures that most of any torsional forces applied to the terminal connector 30 by the power transmission line tend to rotate the connector about the common axis *a*1. Any tendency that the power transmission line may have to rotate the terminal connector 30 about an axis perpendicular to the common axis *a*1 causes no harm because of the limited universal movement permitted by the hemispherical shape of the end portions 38 of the pivot studs and of the sockets 29 in the faces of the blade 19.

In order to minimize corrosion of the hemispherical surfaces 29 and 38, O-rings 45 surround the pivot studs 37 and seal the space between the blade faces 19*a* and 19*b* and the outer end portions 35 of the arms 34.

The foregoing detailed description is given for clearness of understanding only and no unnecessary limitations should be understood therefrom as modifications will be obvious to those skilled in the art.

I claim:

1. In an electric circuit disconnect switch which includes a fixed jaw adapted to be connected to an electric power transmission line and a blade having a hinge terminal end portion about which it is adapted to pivot and having a free end adapted to be selectively engaged with said fixed jaw, an improved hinge terminal mounting comprising, in combination:

a support rotatable about an axis;

a blade having a hinge terminal end portion with opposite faces provided with circular sockets on a common axis;

means mounting said blade on said support with said common axis substantially on a projection of the axis of rotation of said support;

and a terminal connector adapted to be connected to a power transmission line, said terminal connector having a bifurcated end portion defining a bight and substantially parallel arms which are in spaced, flanking relationship to said opposite faces, aligned, cylindrical pivot studs on said arms seated in said sockets, and means flexing said arms relative to said opposite faces to thrust the pivot studs firmly into the sockets.

2. The combination of claim 1 in which the arms contain axially aligned threaded holes, and the pivot studs have threads interengaged with the threads in said holes, so that the thrust of the pivot studs against the sockets acts through said interengaged threads to flex said arms.

3. The combination of claim 2 in which the sockets are of decreasing cross section about the common axis, and the pivot studs have end portions which are complementary to the sockets.

4. The combination of claim 3 in which the sockets and the stud end portions are substantially hemispherical.

5. The combination of claim 4 in which the terminal connector is directly supported only by the power transmission line and the blade.

6. The combination of claim 5 in which the terminal connector has an integral mounting plate extending from the bight in a direction opposite to that of the arms, and holes in the mounting plate on axes substantially parallel to those of the threaded holes in the arms adapt the terminal connector for connection to a power transmission line.

7. The combination of claim 2 which includes resilient means between said bight and said pivot studs biasing said arms toward one another.

8. The combination of claim 7 in which said resilient means comprises a headed bolt which slidably impales aligned holes in said arms and has a threaded end portion, a compression spring between said head and one of said arms, and a nut screwed onto said threaded end portion and bearing on the other of said arms to adjust the force with which said spring biases said arms toward one another.

9. The combination of claim 2 which includes seals surrounding the studs and sealing the space between the blade faces and the arms.

10. The combination of claim 1 which includes resilient means between said bight and said pivot studs biasing said arms toward one another.

11. The combination of claim 10 in which said resilient means comprises a headed bolt which slidably impales aligned holes in said arms and has a threaded end portion, a compression spring between said head and one of said arms, and a nut screwed onto said threaded end portion and bearing on the other of said arms to adjust the force with which said spring biases said arms toward one another.

12. The combination of claim 1 which includes seals surrounding the studs and sealing the space between the blade faces and the arms.

* * * * *